US008245660B2

(12) United States Patent
Dillon et al.

(10) Patent No.: US 8,245,660 B2
(45) Date of Patent: Aug. 21, 2012

(54) DIP COATING APPARATUS WITH HEIGHT ADJUSTABLE COATING TUBES AND METHOD OF COATING

(75) Inventors: Reilly Dillon, Golden Valley, MN (US); Rachel Poker, Apple Valley, MN (US); Gary Johnson, North Saint Paul, MN (US); Daniel Garrett, Inver Grove Heights, MN (US)

(73) Assignee: Oakriver Technology, Inc., Oakdale, MN (US)

( * ) Notice: Subject to any disclaimer, the term of this patent is extended or adjusted under 35 U.S.C. 154(b) by 72 days.

(21) Appl. No.: 12/677,152

(22) PCT Filed: Sep. 13, 2007

(86) PCT No.: PCT/US2007/078434

§ 371 (c)(1),
(2), (4) Date: Mar. 9, 2010

(87) PCT Pub. No.: WO2009/035457

PCT Pub. Date: Mar. 19, 2009

(65) Prior Publication Data

US 2011/0014386 A1 Jan. 20, 2011

(51) Int. Cl.

| | |
|---|---|
| ***B05C 3/12*** | (2006.01) |
| ***B05C 3/132*** | (2006.01) |
| ***B05C 3/109*** | (2006.01) |

(52) U.S. Cl. ..... 118/420; 118/419; 118/421; 427/2.1; 427/430.1; 427/434.6

(58) Field of Classification Search ..... 118/419–421, 118/DIG. 19; 427/2.1, 430.1, 434.6
See application file for complete search history.

(56) References Cited

U.S. PATENT DOCUMENTS

| | | | | |
|---|---|---|---|---|
| 5,429,618 | A | 7/1995 | Keogh | |
| 5,443,453 | A | 8/1995 | Walker et al. | |
| 5,464,650 | A | 11/1995 | Berg et al. | |
| 5,531,715 | A | 7/1996 | Engelson et al. | |
| 5,538,512 | A | 7/1996 | Zenzon et al. | |
| 5,541,167 | A | 7/1996 | Hsu et al. | |
| 5,603,991 | A | 2/1997 | Kupiecki et al. | |
| 5,702,823 | A | 12/1997 | Forrestal et al. | |
| 7,381,273 | B2 * | 6/2008 | Collins | 118/420 |
| 2001/0026834 | A1 | 10/2001 | Chappa et al. | |
| 2006/0210699 | A1 * | 9/2006 | Collins | 427/2.1 |
| 2007/0222132 | A1 * | 9/2007 | Anderson et al. | 269/37 |

* cited by examiner

*Primary Examiner* — Dah-Wei Yuan
*Assistant Examiner* — Stephen Kitt
(74) *Attorney, Agent, or Firm* — Sherrill Law Offices, PLLC

(57) ABSTRACT

A dip coating apparatus and method of dip coating. The apparatus includes a guide surface, a bendable tube, a carriage, and a support assembly. The bendable tube redirectionally engages the guide surface intermediate the first and second longitudinal ends of the tube. The carriage is vertically repositionable and cooperatively engages the tube proximate the first longitudinal end of the tube, whereby vertical repositioning of the carriage effects a change in the vertical distance between the first and second longitudinal ends of the tube. The support assembly releasably suspends an elongate workpiece for introduction of at least a portion of the workpiece into the tube through the first longitudinal end of the coating tube as the carriage is vertically repositioned upwards towards the support assembly.

14 Claims, 13 Drawing Sheets

75
75m
60
30
51
45
50
75b
65b
52
70

DIP COATING APPARATUS WITH HEIGHT ADJUSTABLE COATING TUBES AND METHOD OF COATING

BACKGROUND OF THE INVENTION

Elongate flexible workpieces, such as guidewires and catheters, are often coated to provide a desired property or characteristic, such as enhanced lubricity, improved biological compatibility or rust resistance. The coating is commonly applied by dipping the workpiece into a coating solution, removing the workpiece from the coating solution, and curing the coating.

Typical dip coating equipment employs coating tubes to retain the coating solution and guide the flexible workpieces as they are dipped into the solution. The top of each coating tube is usually equipped with a funnel for facilitating introduction of a workpiece into the coating tube. The coating tubes are commonly straight vertical tubes having a length sufficient to accommodate the longest workpiece to be coated.

While generally effective for coating elongate flexible workpieces, such equipment is rather bulky, arduous to use as the operator must repeatedly reach up, often above his/her head, to mount and dismount the workpieces, and requires substantial quantities of often expensive coating solution to "prime" the system, resulting in considerable waste.

In an effort to overcome these drawbacks, dip coating equipment has been designed with spiral or helical coating tubes submerged in a common reservoir of coating solution. One such coating apparatus is disclosed in United States Published Patent Application 20060210699.

While overcoming many of the drawbacks associated with straight-tube dip coating equipment, it has been discovered that coiled-tube dip coating equipment does not work well with certain types of elongate flexible workpieces as such workpieces are not susceptible to being pushed or threaded along the length of a coiled coating tube, resulting in incomplete coating and/or a kinked workpiece.

Accordingly, a continuing need exists for dip coating equipment capable of consistently and efficiently coating a wide variety of elongate flexible workpieces while using minimal coating solution to prime the system and permitting an operator to mount and dismount workpieces at a comfortable height.

SUMMARY OF THE INVENTION

A first aspect of the invention is a dip coating apparatus having a guide surface, a bendable tube, a carriage, and a support assembly. The bendable tube redirectionally engages the guide surface intermediate the first and second longitudinal ends of the tube. The carriage is vertically repositionable and cooperatively engages the tube proximate the first longitudinal end of the tube, whereby vertical repositioning of the carriage effects a change in the vertical distance between the first and second longitudinal ends of the tube. The support assembly releasably suspends an elongate workpiece for introduction of at least a portion of the workpiece into the tube through the first longitudinal end of the coating tube as the carriage is vertically repositioned upwards towards the support assembly.

A second aspect of the invention is a dip coating apparatus having a tube, a carriage and a support assembly. The carriage is vertically repositionable and comprises a basin defining a fluid retention cavity in fluid communication with the tube for supplying fluid to the tube when the carriage is moved upward, and receiving overflow fluid from the tube when the carriage is moved downward. The support assembly releasably suspends an elongate workpiece for introduction of at least a portion of the workpiece into the tube through the first longitudinal end of the coating tube as the carriage is vertically repositioned upwards towards the support assembly.

A third aspect of the invention is a method of dip coating an elongate workpiece. The method includes the steps of (i) moving the first longitudinal end of a tube defining a lumen upwards away from the second longitudinal end of the tube and towards a workpiece so as to introduce a length of the workpiece into the lumen and into contact with coating solution retained within the lumen, and (ii) moving the first longitudinal end of the tube downward towards the second longitudinal end of the tube and away from the partially coated workpiece until the partially coated workpiece is removed from the lumen defined by the tube.

DETAILED DESCRIPTION OF THE INVENTION

Nomenclature

10 Dip Coating Apparatus
20 Workpiece Support Assembly
30 Coating Tube Assembly
40 Frame
45 Carriage Support Stanchions
50 Tube (Collapsible)
51 First Longitudinal End of Tube
52 Second Longitudinal End of Tube
59 Lumen Defined by Tube
60 Carriage

Figure 1:
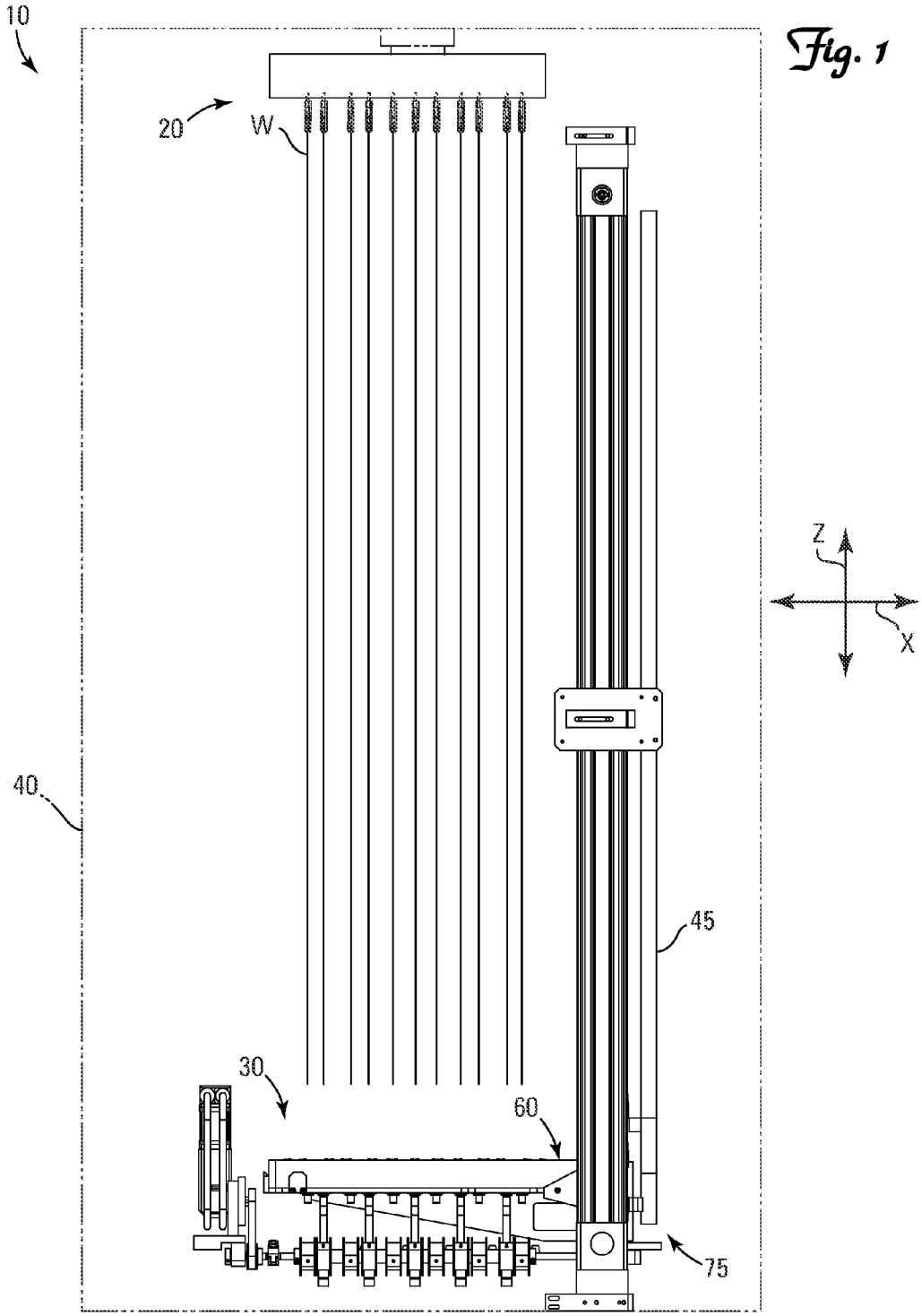
FIG. 1 is a front view of one embodiment of the invention.
Figure 2:
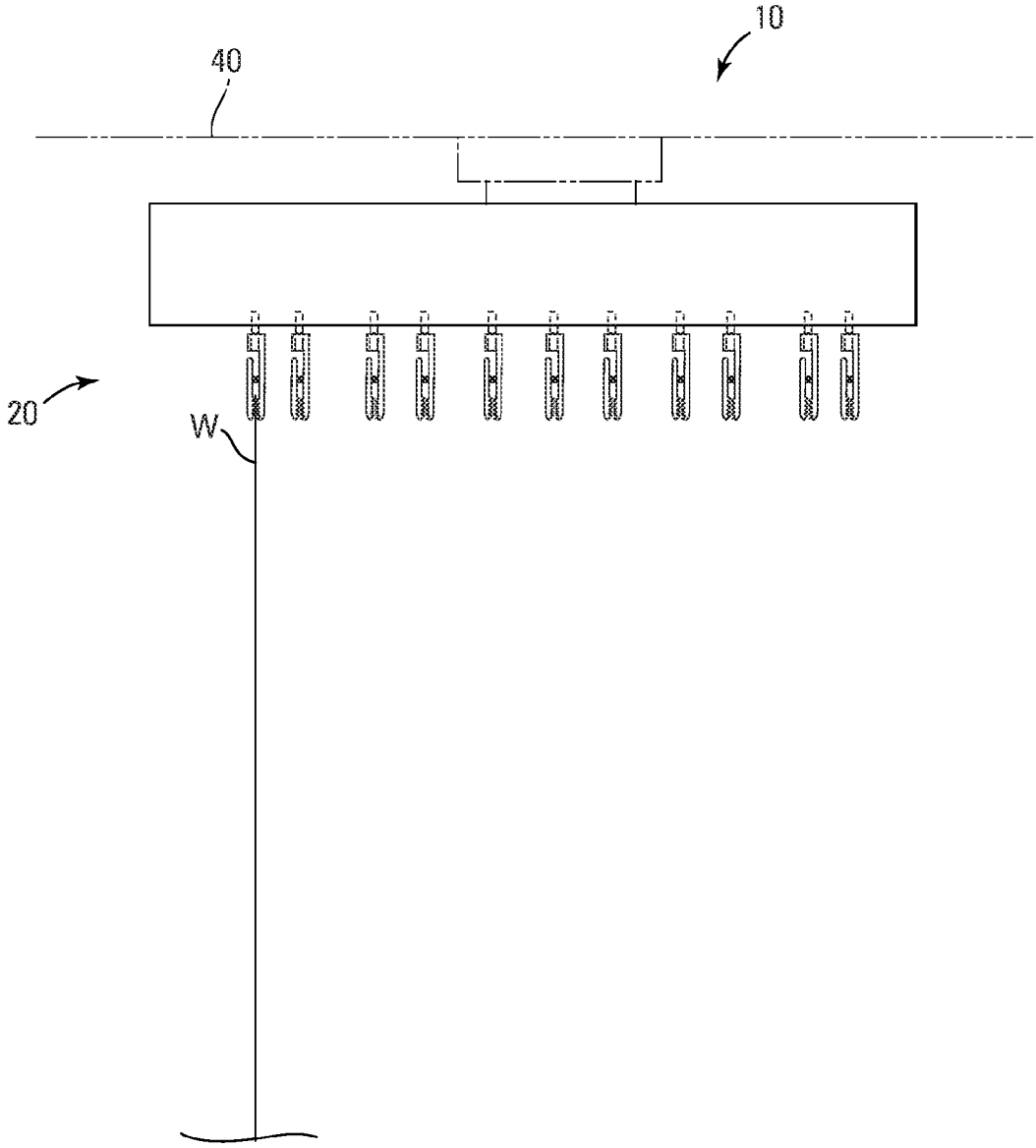
FIG. 2 is a front view of the workpiece support assembly portion of the dip coating apparatus shown in FIG. 1 depicting a single workpiece.

60*a* Base
60*b* Sidewalls
61 Coupling
62 Funnel
65 Drive Mechanism for Carriage
65*b* Belt
65*m* Motor
69 Fluid Retention Cavity
70 Take-Up Spools
75 Drive Mechanism for Take-Up Spool
75*b* Belt
75*m* Motor
79 Nip Point
80 Reservoir
90 Pump
100 Controller
145 Traveler Support Stanchions
170 Traveler Board
171 Nip Roller
172 Pulley
179 Nip Point
250 Tube (Bendable)
251 First Longitudinal End of Tube
252 Second Longitudinal End of Tube
259 Lumen Defined by Tube
260 Carriage
262 Funnel
270 Guide
S Coating Solution
W Workpiece
x Horizontal Direction
y Transverse Direction
z Vertical Direction
$z_1$ Upward Direction
$z_2$ Downward Direction
Construction First Embodiment Referring to FIG. 1, the dip coating apparatus 10 includes a frame 40 supporting a workpiece support assembly 20 over a coating tube assembly 30. The workpiece support assembly 20 includes clips (unnumbered) or other fastening mechanisms for releasably suspending elongate workpieces W in vertical z alignment above tubes 50 or 250 in the coating tube assembly 30.

Typical workpiece support assemblies 20 suitable for use include those shown and described in United States Patent Application Publications 2001/0026834 and 2006/0210699.

Figure 3A:
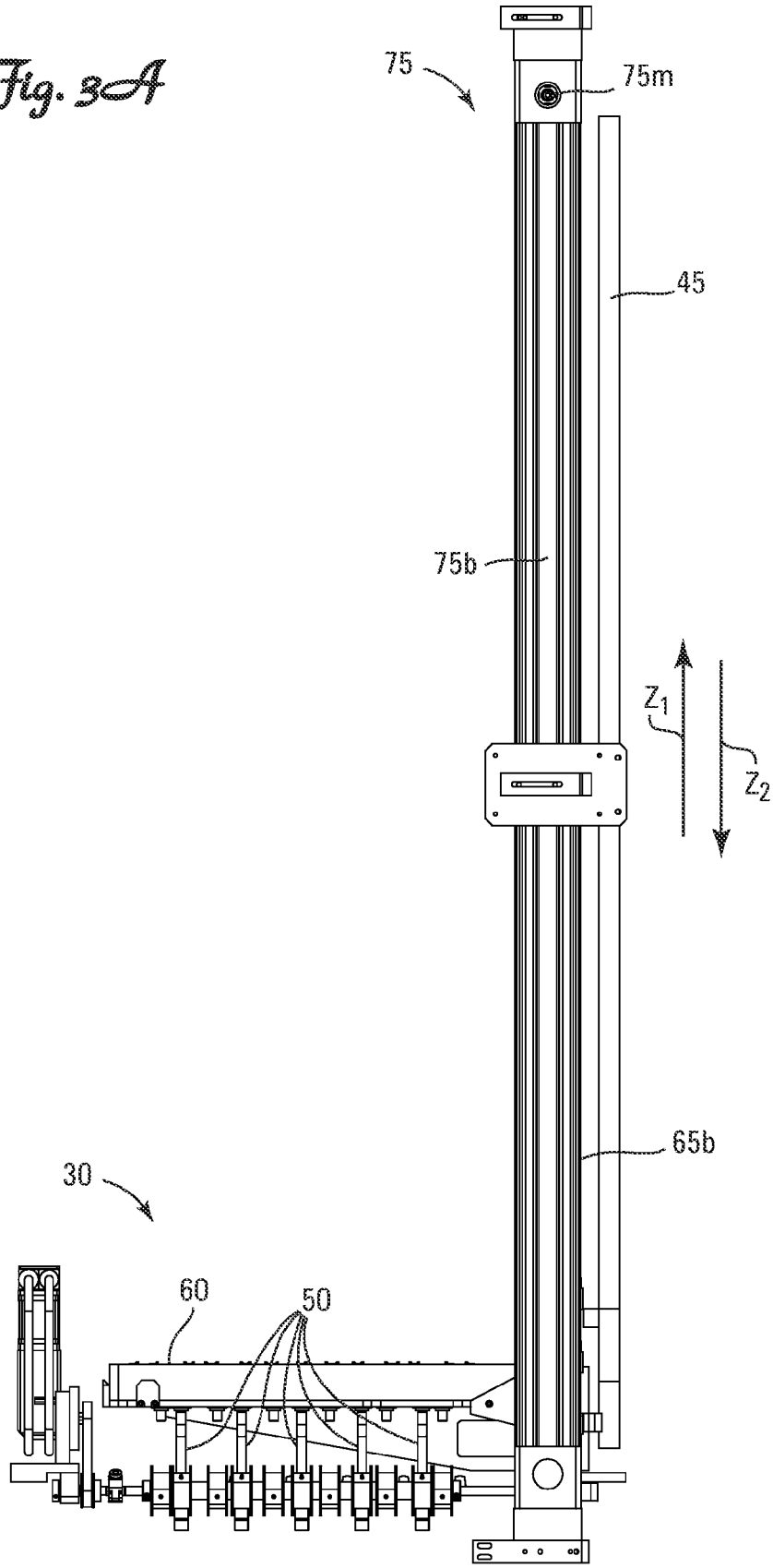
FIG. 3A is a front view of the coating tube assembly portion of the dip coating apparatus shown in FIG. 1 in the retracted position and depicting every other tube.
Figure 3B:
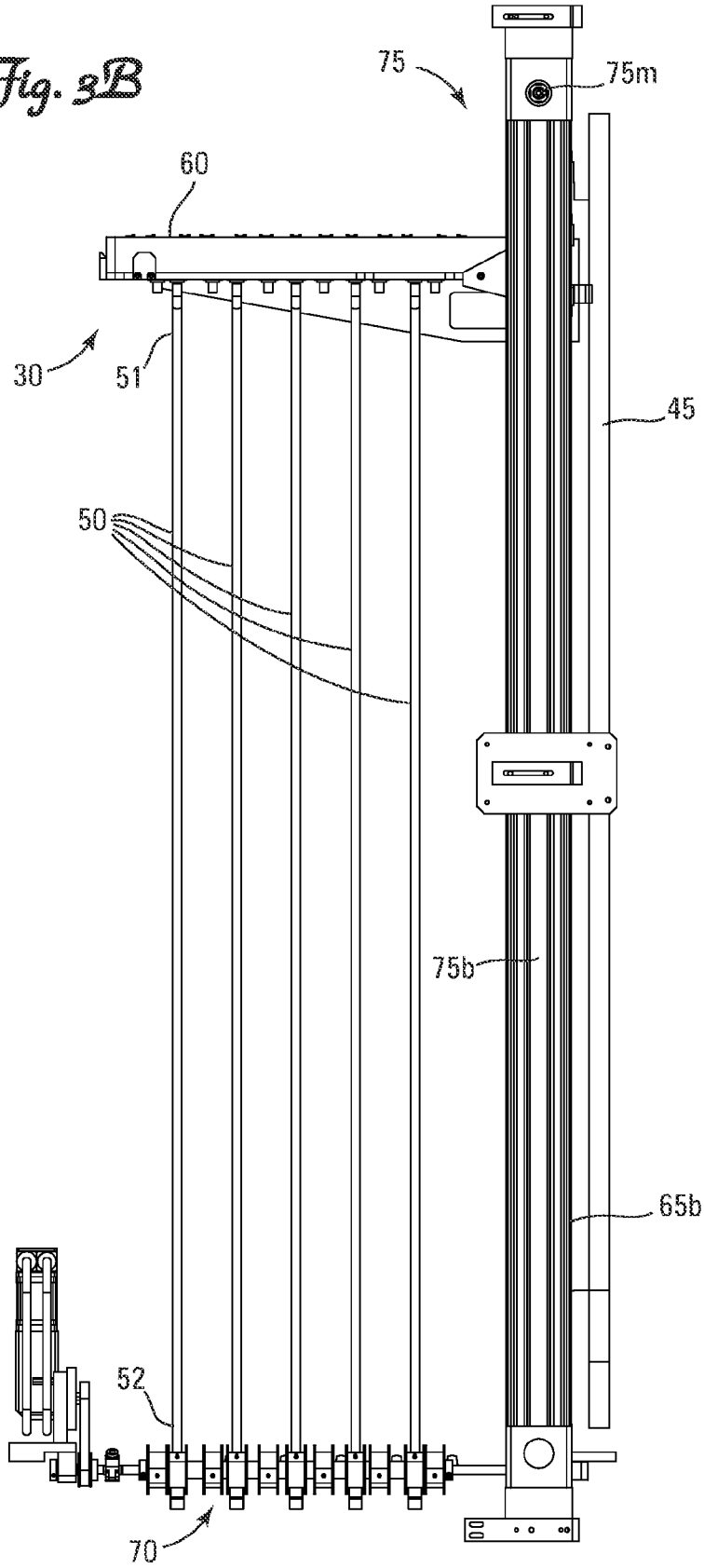
FIG. 3B is a front view of the coating tube assembly portion of the dip coating apparatus shown in FIG. 1 in the extended position and depicting every other tube.

Referring to FIGS. 1, 3A and 3B, one embodiment of the coating tube assembly 30 includes tubes 50 attached at the first longitudinal end 51 to a carriage 60 and attached at the second longitudinal end 52 to a take-up spool 70.

The tubes 50 used in the embodiment depicted in FIGS. 1, 3A, 3B, 4-7, 10A and 10B are collapsible, permitting the tubes 50 to be flattened for winding onto the take-up spools 70 and for permitting the sidewalls (unnumbered) of the tube 50 to be pinched together anywhere along the longitudinal length of the tube 50 to seal the lumen 59 defined by the tube 50. Suitable tubes 50 include those manufactured from plastic film having a thickness of up to about 20 mil.

Figure 10A:
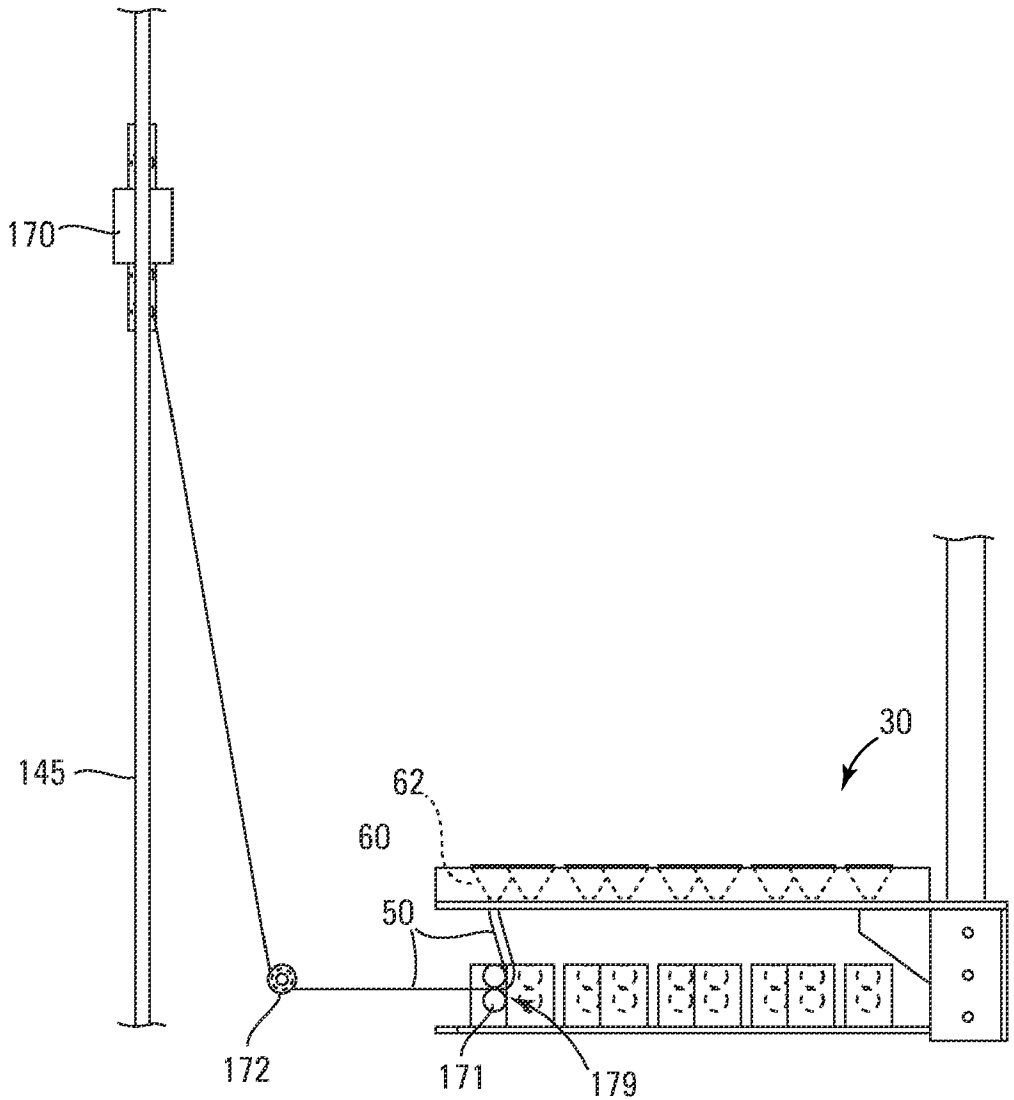
FIG. 10A is a front view of an alternative take-up system in the retracted position with a single tube attached.
Figure 10B:
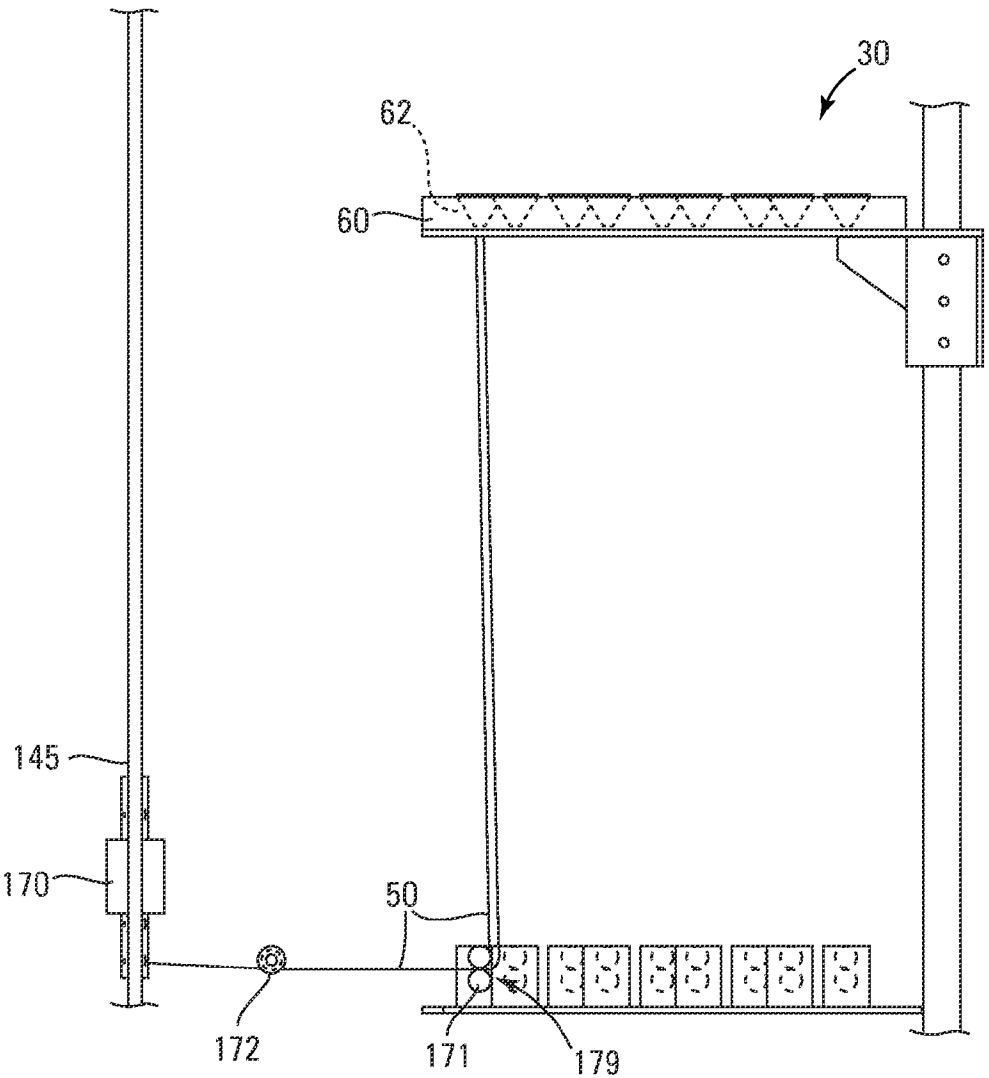
FIG. 10B is a side view of the alternative take-up system shown in FIG. 10A in the extended position.

The carriage 60 used in the embodiment depicted in FIGS. 1, 3A, 3B and 4-7 and the embodiment depicted in FIGS. 10A and 10B includes a base 60*a*, and sidewalls 60*b* defining a fluid retention cavity 69 capable of holding a supply of coating solution S. The carriage 60 is driven by any suitable drive mechanism 65, such as a belt 65*b* and electric motor 65*m*, to reciprocate along a vertical stanchion 45 as between a retracted position, shown in FIGS. 3A and 10A, and an expanded position, shown in FIGS. 3B and 10B.

Figure 4:
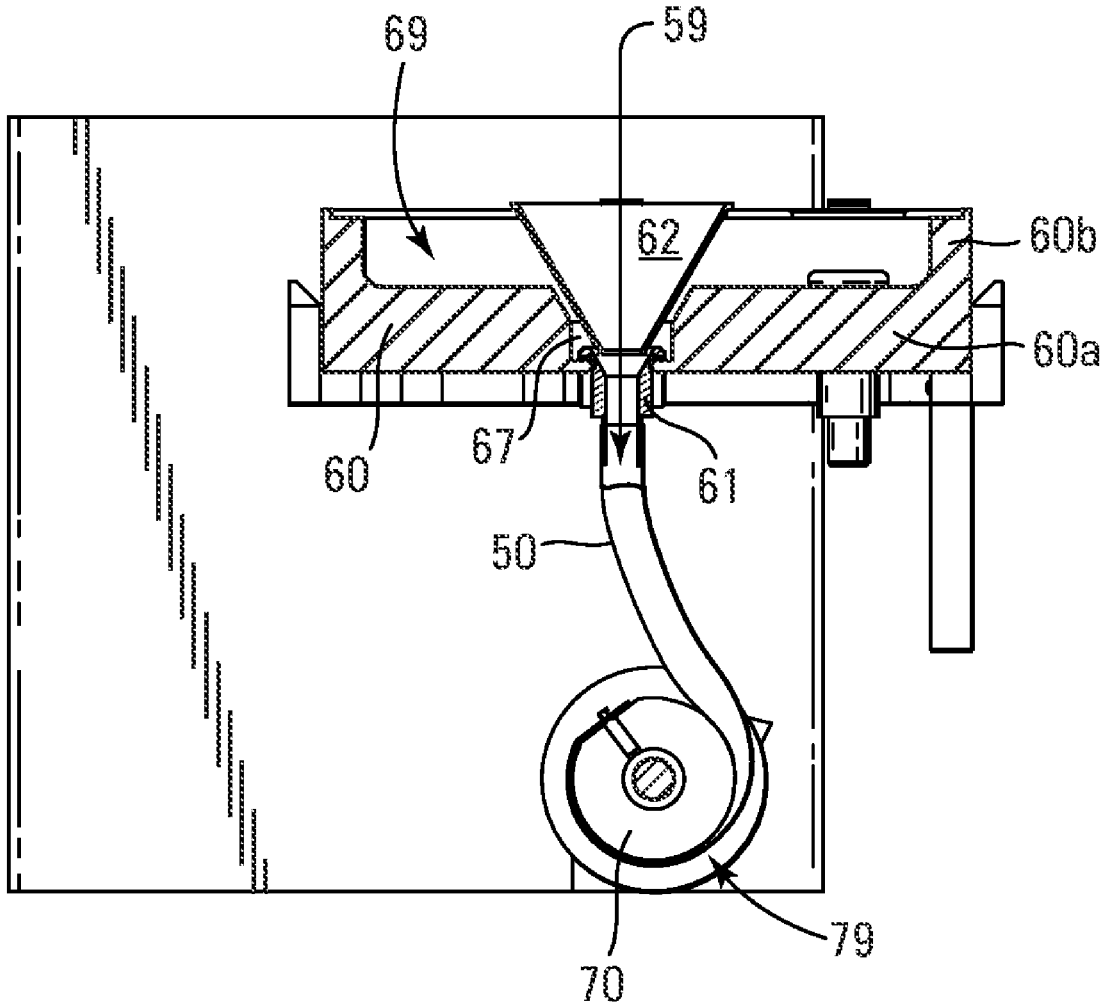
FIG. 4 is a side view of the coating tube assembly portion of the dip coating apparatus shown in FIG. 1 in the refracted position.
Figure 5:
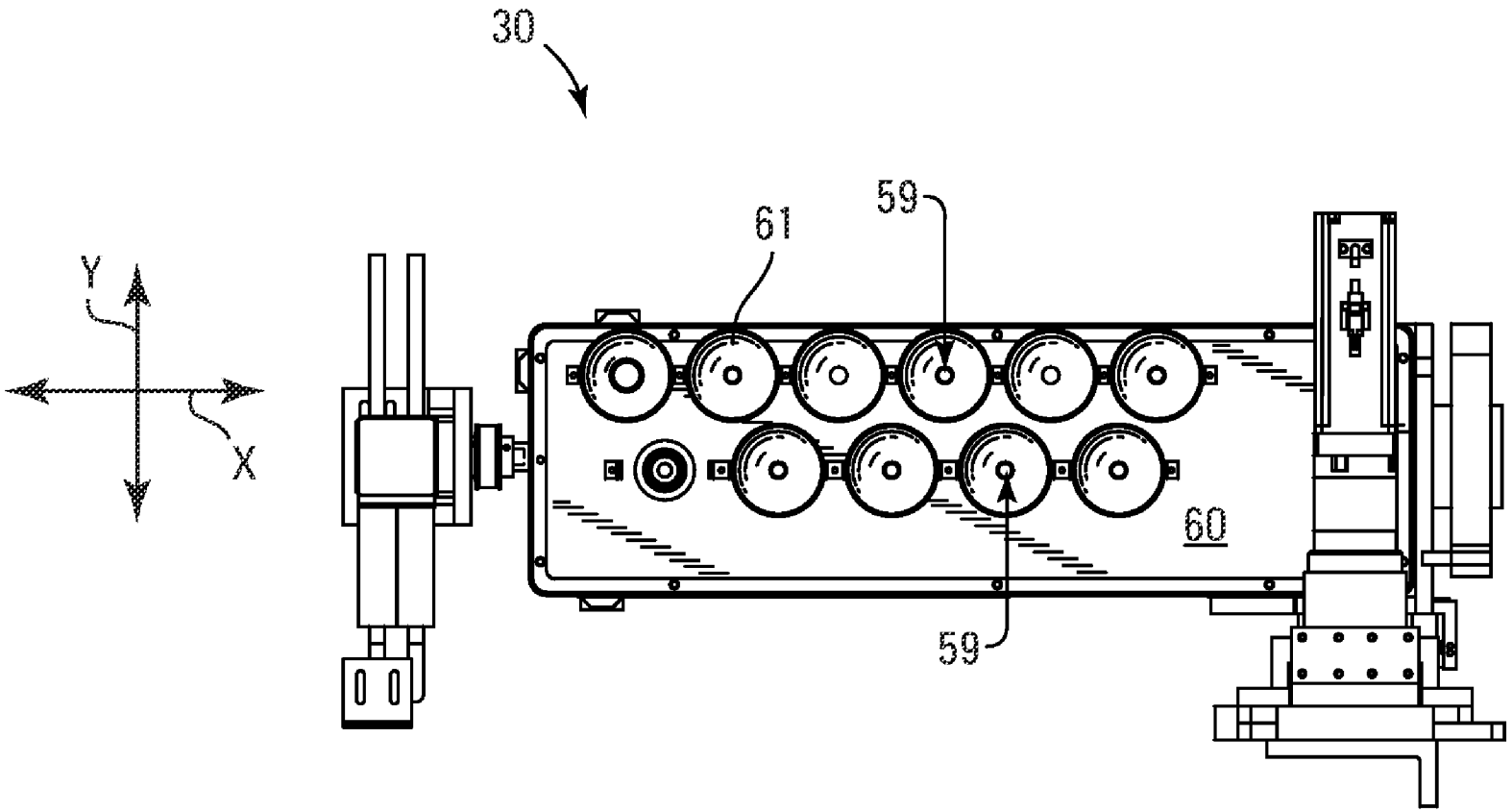
FIG. 5 is a top view of the carriage portion of the coating tube assembly shown in FIG. 1.
Figure 6:
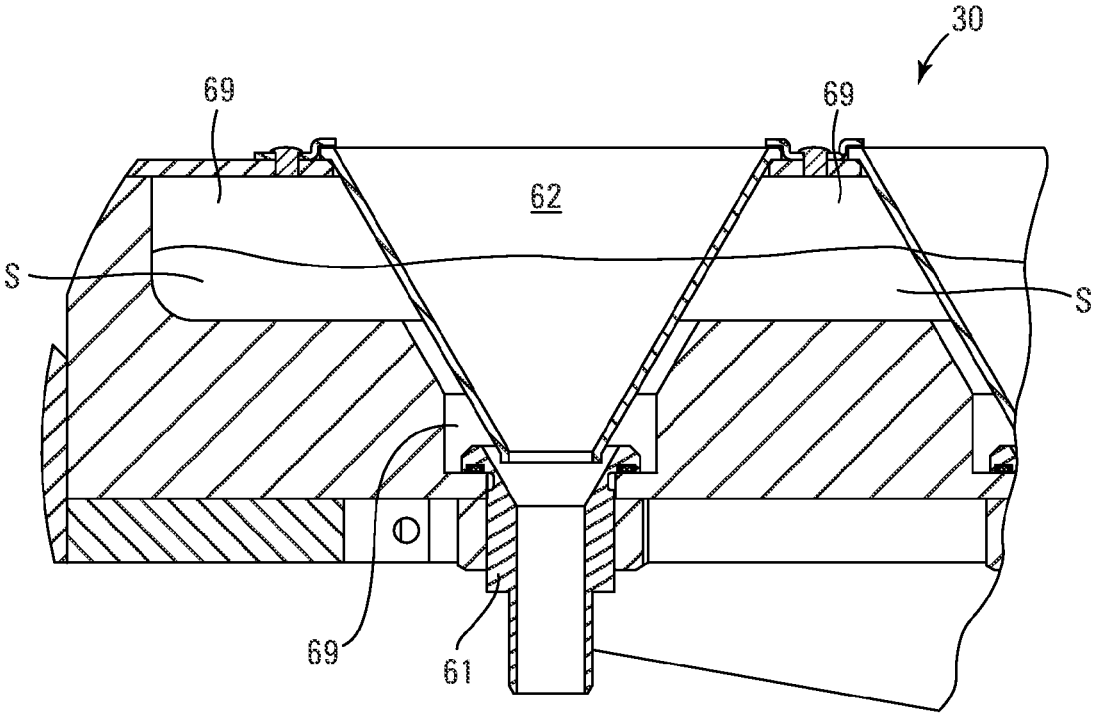
FIG. 6 is an enlarged cross-sectional side view of the carriage shown in FIG. 4 taken along line 6-6 with the tubes removed.
Figure 7:
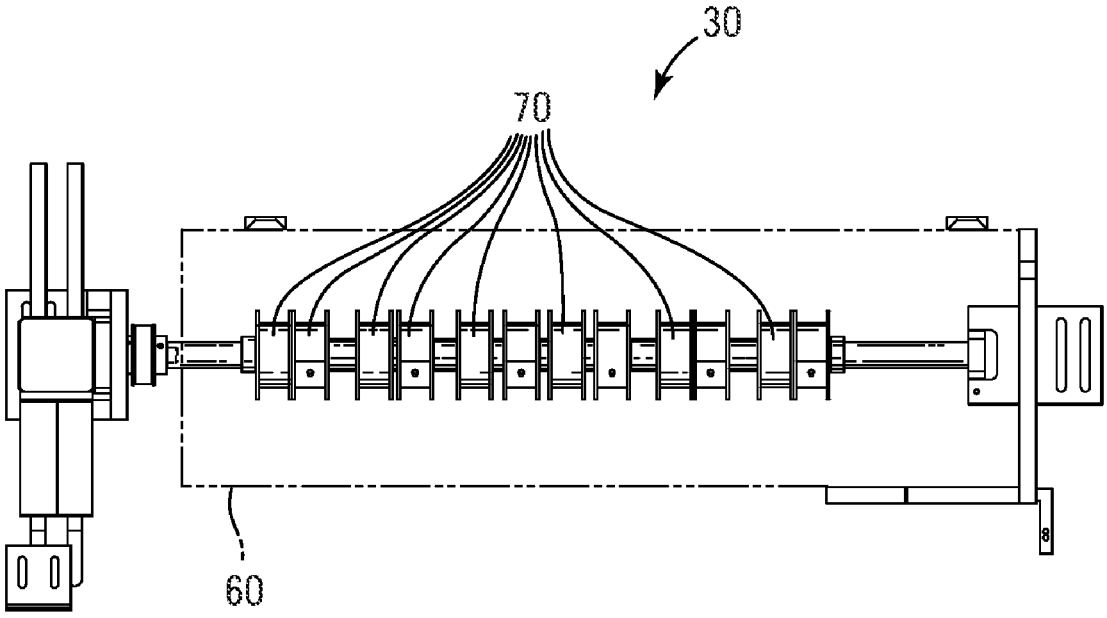
FIG. 7 is a top view of the take-up spool system shown in FIG. 1 with the tubes removed.
Figure 8:
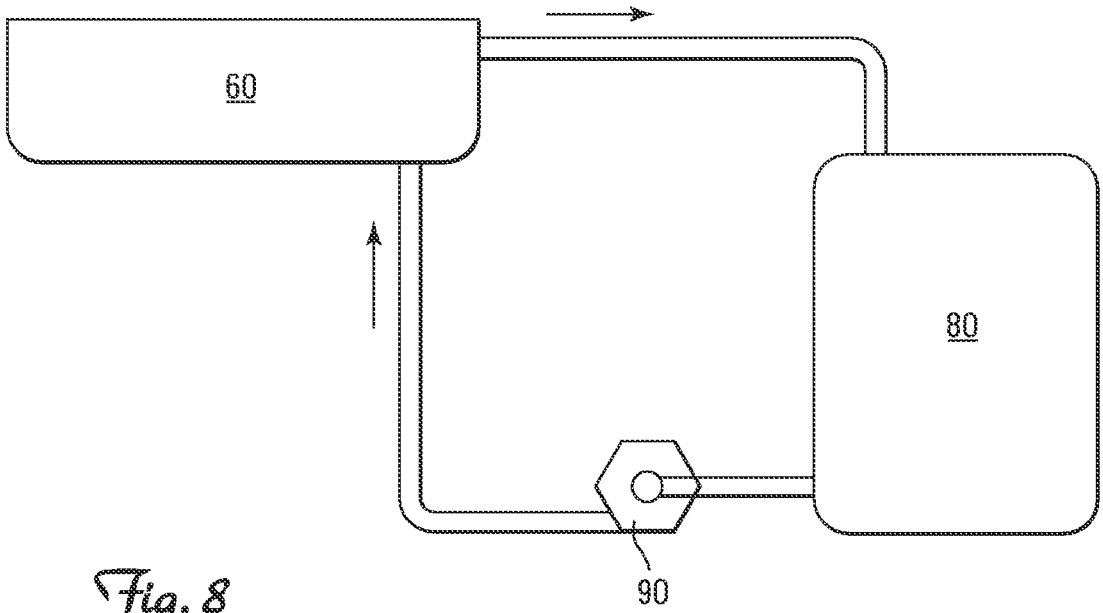
FIG. 8 is a schematic of the fluid flow between the carriage and a separate reservoir.

As shown in FIG. 4, the first longitudinal end 51 of each tube 50 is secured to the base 60*a* and placed in fluid communication with the fluid retention cavity 69 by a suitable coupling 61. A guide funnel 62 extends upward $z_1$ from each coupling 61 for guiding a workpiece W suspended from the workpiece support assembly 20 into the lumen 59 of the corresponding tube 50. An annual gap (not shown) is preferably provided between each coupling 61 and guide funnel 62 for permitting fluid to flow between the fluid retention cavity 69 and the lumen 59 of the tube 50.

A separate reservoir 80 containing additional coating solution S may be placed in fluid communication with the fluid retention cavity 69 via suitable inlet/outlet orifices (not shown) in the carriage 60 and the reservoir 80, for supplying additional coating solution S to the fluid retention cavity 69 when necessary and receiving any overflow of coating solution S from the fluid retention cavity 69. The reservoir 80 may be entirely separate from the coating apparatus 10 connected only by suitable hosing (not shown), may be attached to the frame 40, or even attached to the carriage 60 for movement along the stanchion 45 in conjunction with the carriage 60. Fluid flow may be effected solely by gravity, or with the aid of a pump 90.

As shown in FIGS. 1, 3A, 3B, 4, 7, 10A and 10B, the second longitudinal end 52 of each tube 50 is secured to a slack control and tensioning system. One suitable slack control and tensioning system, shown in FIGS. 1, 3A, 3B, 4 and 7 is a take-up spool 70. The take-up spools 70 keep the tubes 50 taut by "reeling-in" and "reeling-out" the tubes 50 as the carriage 60 moves between the retracted and expanded positions, and neatly winding any slack in the tubes 50 around the spool 70. The take-up spools 70 place sufficient tension on the tubes 50 to cause the tubes 50 to collapse as they come into contact with the take-up spools 70, or alternatively into contact with a nip roller (not shown), so as to create a nip point 79 at which the lumen 59 of the tube 50 is sealed. The take-up spools 70 are driven by any suitable drive mechanism 75, such as a belt 75*b* and electric motor 75*m*.

Another suitable slack control and tensioning system, shown in FIGS. 10A and 10B is a traveler board 170 driven by any suitable drive mechanism (not shown), such as a belt (not shown) and electric motor (not shown), to reciprocate along a vertical stanchion 145 as between a retracted position, shown in FIG. 10A, and an expanded position shown in FIG. 10B. The traveler board 170 keeps the tubes 50 taut by moving a distance along the vertical stanchion 145 equal and opposite to the distance traveled by the carriage 60 along the vertical stanchion 45. The tubes 50 are guided from the carriage 60 to the travel board 170 by a nip roller 171 positioned immediately underneath each corresponding coupling 62, and a pulley 172. As with the take-up spools 70, the traveler board 170 places sufficient tension on the tubes 50 to cause the tubes 50 to collapse as they come into contact with the nip rollers 171 so as to create a nip point 179 at which the lumen 59 of the tube 50 is sealed.

Figure 9:
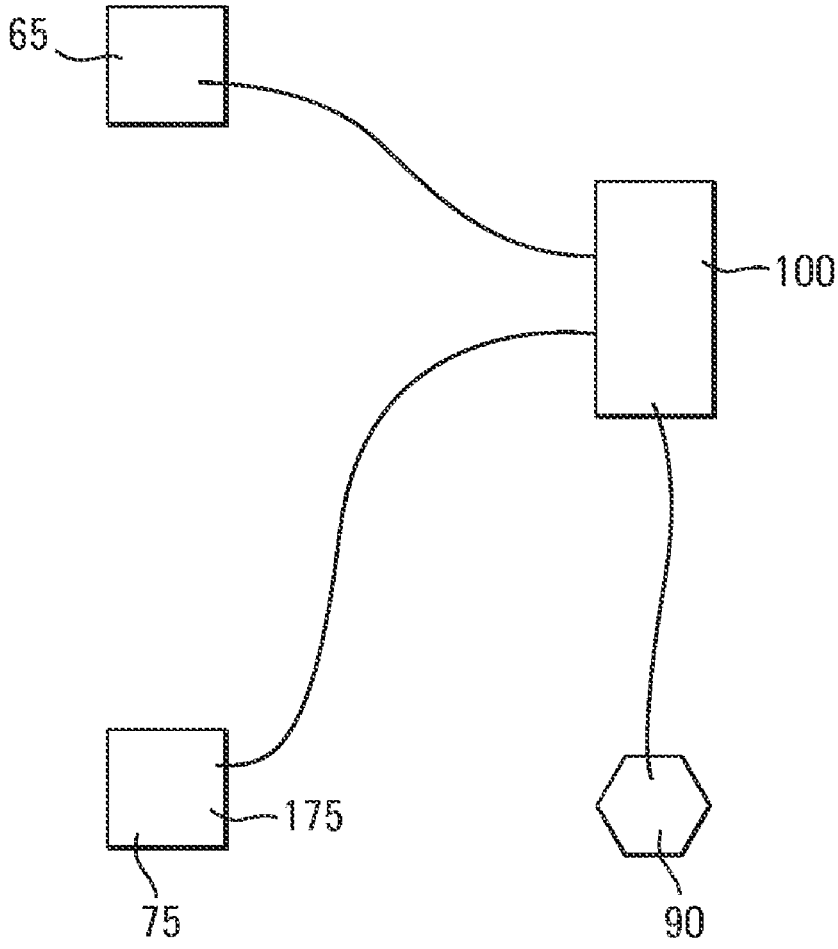
FIG. 9 is an electrical schematic of the dip coating apparatus shown in FIG. 1.

In order to coordinate movement of the carriage 60 and the slack control and tensioning system, the drive mechanisms for each must be coordinated by a suitable controller 100, such as depicted schematically in FIG. 9, to ensure that the length of tubing 50 "reeled-out" from the take-up spools 70 or the distance traveled by the traveler board 170 corresponds to the distance traveled by the carriage 60. Alternatively, the carriage 60 and slack control and tensioning system can be driven by the same motor.

Second Embodiment

Figure 11B:
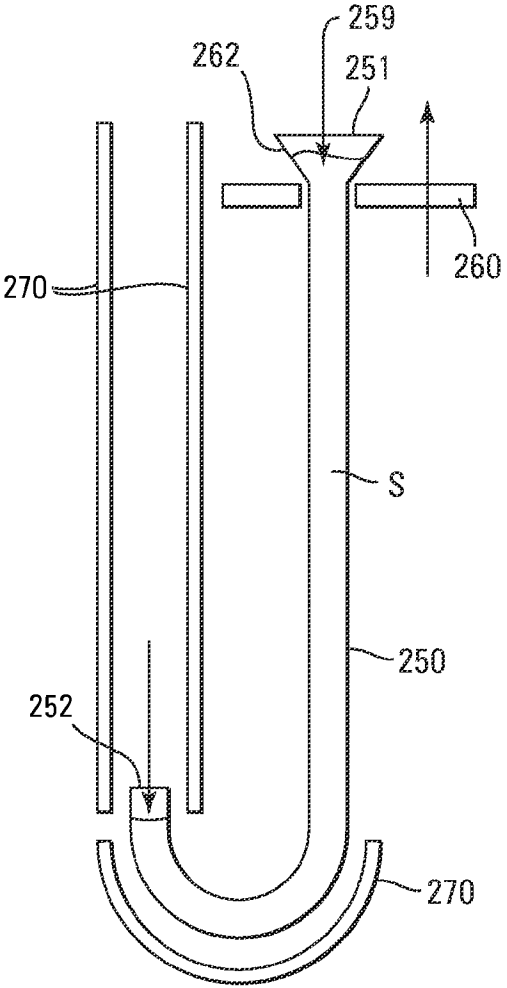
FIG. 11B is a front view of the alternative coating tube assembly shown in FIG. 11A in the extended position.
Figure 11A:
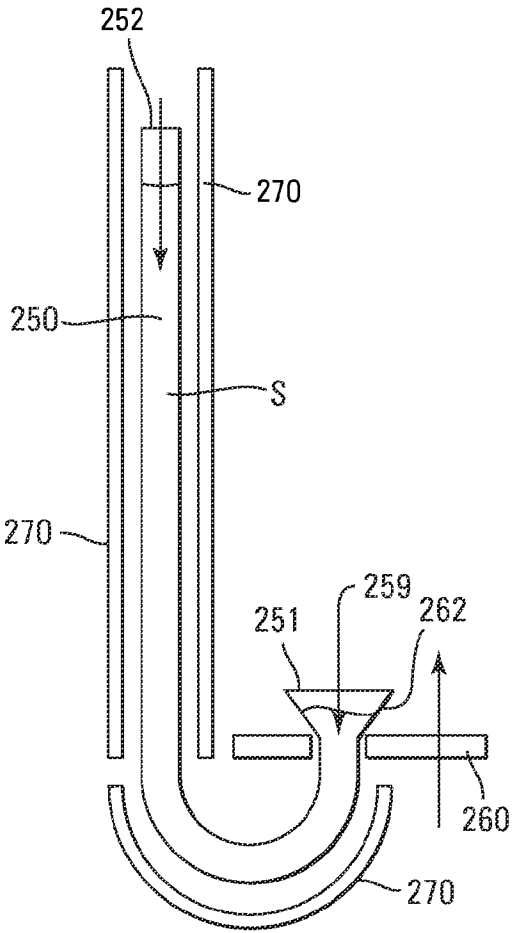
FIG. 11A is a front view of one tube filled with coating solution from an alternative coating tube assembly in the retracted position.

Referring to FIGS. 11A and 11B, a second embodiment of the coating tube assembly 30 includes tubes 250 attached at the first longitudinal end 251 to a carriage 260, sealed at the second longitudinal end 252 and filled with a coating solution S.

The tubes 250 used in this embodiment can be bent without collapsing so as to permit the tubes 50 to be curved back upon themselves about a fairly tight turning radius of less than about 20 cm, preferably less than about 10 cm and most preferably less than about 5 cm, without collapsing the lumen 259 of the tube 250. Suitable tubes 50 include those manufactured from rubber or polyethylene.

The tubes 250 are directed by a guide 270 which slidably engages the tubes 250. The tubes 250 can be guided along any desired path ranging from a 180° bend, a 90° bend, two separate 90° bends, a spiral, a helix, etc. Generally, the path should be selected to minimize the overall size of the entire coating tube assembly 30 while avoiding sharp turns and providing a straight vertical section in contact with a workpiece W being coated.

As with the first embodiment, the carriage 260 is driven by any suitable drive mechanism (not shown), such as an electric motor (not shown) and a belt (not shown), to reciprocate along a vertical stanchion (not shown) as between a lower start position, shown in FIG. 11A, and an upper coating position, shown in FIG. 11B.

A guide funnel 262 engages the first longitudinal end 251 of each tube 250 for guiding a workpiece W suspended from the workpiece support assembly 20 into the lumen 259 of the corresponding tube 250.

Use

First Embodiment

The first embodiment of the coating apparatus 10 of the present invention provides consistent and efficient coating of a wide variety of elongate flexible workpieces W while using minimal coating solution S to prime the system and permitting an operator (not shown) to mount and dismount workpieces W at a comfortable height. Use involves the steps of (i) positioning the carriage 60 into the retracted position as shown in FIG. 3A, (ii) filling the fluid retention cavity 69 of the carriage 60 and the lumen 59 of each tube 50 down to the nip point 79 with coating solution S, (iii) clipping workpieces W onto the workpiece support assembly 20, and (iv) activating the coating apparatus 10 to perform a coating cycle.

When the slack control and tensioning system is take-up spools 70, the coating cycle involves (a) immersing a lowermost length of each workpiece W suspended from the workpiece support assembly 20 into coating solution S contained within the lumen 59 of a vertically z aligned tube 50 by simultaneously driving the carriage 60 upwards $z_1$ towards the workpieces W while unreeling a corresponding length of tubing 50 from the take-up spool 70, causing coating solution S to flow from the fluid retention cavity 69 defined by the carriage 60 into the lumen 59 of each tube 50 as the length of the lumen 59 above the nip point 79 increases, followed by (b) withdrawing the now coated lowermost length of each workpiece W from the corresponding tube 50 by driving the carriage 60 downward $z_2$ away from the workpieces W while winding a corresponding length of tubing 50 onto the take-up spool 70, causing coating solution S to flow from the lumen 59 of each tube 50 back into the fluid retention cavity 69 defined by the carriage 60 as the length of the lumen 59 above the nip point 79 decreases.

When the slack control and tensioning system is a traveler board 170, the coating cycle involves (a) immersing a lowermost length of each workpiece W suspended from the workpiece support assembly 20 into coating solution S contained within the lumen 59 of a vertically aligned tube 50 by simultaneously driving the carriage 60 upwards $z_1$ towards the workpieces W while driving the traveler board 170 an equal distance downward $z_2$, causing coating solution S to flow from the fluid retention cavity 69 defined by the carriage 60 into the lumen 59 of each tube 50 as the length of the lumen 59 above the nip point 179 increases, followed by (b) withdrawing the now coated lowermost length of each workpiece W from the corresponding tube 50 by driving the carriage 60 downward $z_2$ away from the workpieces W while driving the traveler board 170 an equal distance upward $z_1$, causing coating solution S to flow from the lumen 59 of each tube 50 back into the fluid retention cavity 69 defined by the carriage 60 as the length of the lumen 59 above the nip point 79 decreases.

Second Embodiment

The second embodiment of the coating apparatus 10 of the present invention also provides consistent and efficient coating of a wide variety of elongate flexible workpieces W while using minimal coating solution S to prime the system and permitting an operator (not shown) to mount and dismount workpieces W at a comfortable height. Use involves the steps of (i) positioning the carriage 260 into the upper coating position as shown in FIG. 10B (ii) filling the lumen 259 of each tube 250 with coating solution S, (iii) repositioning the carriage 260 into the lower start position as shown in FIG. 10A, (iv) clipping workpieces W onto the workpiece support assembly 20, and (v) activating the coating apparatus 10 to perform a coating cycle.

The coating cycle involves (a) immersing a lowermost length of each workpiece W suspended from the workpiece support assembly 20 into coating solution S contained within the lumen 259 of a vertically aligned tube 250 by driving the carriage 260 from the lower start position upwards towards the workpieces W into the upper coating position, followed by (b) withdrawing the now coated lowermost length of each workpiece W from the corresponding tube 250 by driving the carriage 260 downward $z_2$ from the upper coating position away from the workpieces W towards the lower start position.

We claim:

1. A dip coating apparatus, comprising:

(a) a member providing a guide surface, effective for engaging and redirecting a bendable object, (b) a bendable tube having a first longitudinal end and a second longitudinal end, and redirectionally engaging the guide surface intermediate the first and second longitudinal ends, (c) a vertically repositionable carriage cooperatively engaging the tube proximate the first longitudinal end of the tube whereby vertical repositioning of the carriage effects a change in the vertical distance between the first and second longitudinal ends of the tube, and (d) a support assembly for releasably suspending an elongate workpiece for introductions of at least a portion of the workpiece into the tube through the first longitudinal end of the tube as the carriage is vertically repositioned upwards towards the support assembly.

2. The apparatus of claim 1 wherein (i) the bendable tube is a collapsible tube, and (ii) the apparatus further comprises a nip for sealingly pinching the tube intermediate the first and second longitudinal ends of the tube to define a nip point on the tube which travels along the longitudinal length of the tube as the tube is vertically repositioned by the carriage.

3. The apparatus of claim 2 wherein the collapsible tube is constructed from a thin, flexible film having a thickness of less than 20 mil.

4. The apparatus of claim 2 wherein the guide member is a driven take-up spool effective for winding-up any slack in the tube and functioning as the nip.

5. The apparatus of claim 2 wherein the nip is fixedly attached to a stationary frame.

6. The apparatus of claim 1 wherein (i) the second longitudinal end the tube is sealed, (ii) the guide member is at least one guide pulley, and (iii) the bendable tube is redirected at least 135° without sealingly collapsing the tube.

7. The apparatus of claim 1 wherein (i) the second longitudinal end the tube is sealed, (ii) the guide member is at least one guide pulley, and (iii) the bendable tube is redirected between 170° and 190° without sealingly collapsing the tube.

8. The apparatus of claim 2 wherein the carriage comprises a basin defining a fluid retention cavity in fluid communication with the tube for supplying fluid to the tube when the carriage is moved upwards, and receiving overflow fluid from the tube when the carriage is moved downwards.

9. The apparatus of claim 8 further comprising a reservoir in fluid communication with the fluid retention cavity defined by the carriage for supplying fluid to the fluid retention cavity when the carriage is moved upwards, and receiving fluid from the retention cavity when the carriage is moved downwards.

10. The apparatus of claim 9 further comprising a pump for pumping fluid from the reservoir into the fluid retention cavity.

11. The apparatus of claim 1 wherein (i) the apparatus includes a plurality of bendable tubes, each (a) having a first longitudinal end and a second longitudinal end, (b) redirectionally engaging the guide surface intermediate the first and second longitudinal ends, and (c) cooperatively engaging the carriage proximate the first longitudinal end of the tube whereby vertical repositioning of the carriage effects a change in the vertical distance between the first and second longitudinal ends of each tube, and (ii) the support assembly is effective for releasably suspending a plurality of elongate workpieces for introduction of at least a portion of each workpiece into one of the tubes through the first longitudinal end of the tube as the carriage is vertically repositioned upwards towards the support assembly.

12. The apparatus of claim 11 wherein the apparatus includes a separate guide member for each tube.

13. A dip coating apparatus, comprising:

(a) a tube having a first longitudinal end and a second longitudinal end, (b) a vertically repositionable carriage comprising a basin defining a fluid retention cavity in fluid communication with the tube for supplying fluid to the tube when the carriage is moved upward, and receiving overflow fluid from the tube when the carriage is moved downward, the carriage cooperatively engaging the tube proximate the first longitudinal end of the tube whereby vertical repositioning of the carriage effects a change in the vertical distance between the first and second longitudinal ends of the tube, and (c) a support assembly for releasably suspending an elongate workpiece for introductions of at least a portion of the workpiece into the tube through the first longitudinal end of the coating tube as the carriage is vertically repositioned upwards towards the support assembly.

14. The apparatus of claim 13 further comprising a reservoir in fluid communication with the fluid retention cavity defined by the carriage for supplying fluid to the fluid retention cavity when the carriage is moved upwards, and receiving fluid from the retention cavity when the carriage is moved downwards.

* * * * *